US005778719A

United States Patent [19]

Takao

[11] Patent Number: 5,778,719

[45] Date of Patent: Jul. 14, 1998

[54] METHOD OF STRETCH-FORMING A CHANNEL MATERIAL

[75] Inventor: Masayoshi Takao, Akashi, Japan

[73] Assignee: Kawasaki Hydromechanics Corp., Hyogo, Japan

[21] Appl. No.: 833,072

[22] Filed: Apr. 3, 1997

[30] Foreign Application Priority Data

Apr. 12, 1996 [JP] Japan ..... 8-115713

[51] Int. Cl.[6] ..... B21D 9/01

[52] U.S. Cl. ..... 72/296; 72/302; 72/465

[58] Field of Search ..... 72/295–297, 302, 72/304, 465, 466

[56] References Cited

U.S. PATENT DOCUMENTS

| | | | |
|---|---|---|---|
| 1,264,249 | 4/1918 | Yoder | 72/295 |
| 2,693,637 | 11/1954 | Peabody | 72/296 |
| 2,850,071 | 9/1958 | Kraybill | 72/297 |
| 2,868,264 | 1/1959 | Jones | 72/296 |
| 2,889,864 | 6/1959 | Bowswer | 72/297 |
| 3,425,258 | 2/1969 | Dawson | 72/303 |
| 3,426,569 | 2/1969 | Brauer | 72/295 |
| 5,327,765 | 7/1994 | Weykamp | 72/296 |

*Primary Examiner*—Daniel C. Crane

*Attorney, Agent, or Firm*—Birch, Stewart, Kolasch & Birch, LLP

[57] ABSTRACT

A channel material 2 of predetermined length is fed into a stretch forming apparatus 1 and bending the material 2 in predetermined form. A mold 3 in the apparatus 1 is placed in symmetry forward and rearward of the apparatus 1 so as to bend the channel material in lateral symmetry, arranging a plurality of cores 4 along the mold 3 in such a manner that they can be inserted into and removed from the inside of the material 2 to be fed into the apparatus 1. The arranged cores 4 are supporting in such a manner that they can slide forward and rearward along the bend part of the material 2, and the material 2 is bent in predetermined forward and rearward directions while stretching both end portions of the material 2 by means of stretch cylinders 13 so as to form a forward and rearward symmetric molding. Thus, it is possible to stretch-form at high production efficiency even a laterally symmetric channel material for a vehicle frame or the like.

14 Claims, 5 Drawing Sheets

METHOD OF STRETCH-FORMING A CHANNEL MATERIAL

FIELD OF THE INVENTION

The present invention relates to a method of stretch-forming a channel material in the field of press molding, and in particular to a method of stretch forming for forming a channel material bent in lateral symmetry.

BACKGROUND OF THE INVENTION

Conventionally, methods of stretch forming have been used to bend extruded materials and channel materials such as aluminum and other metal. The conventional methods of stretch forming each include stretching a molding material with a constant tensile force from both sides by means of stretch cylinders, and bending the material along a mold.

The conventional methods, however, are apt to deform the sectional forms of extruded materials and channel materials being molded. A recent art of stretch forming includes filling the inside of a molding material with a low-temperature fusible material such as lead etc., and bending the filled molding material. This art is not efficient, however, because it requires a long time and/or much labor to take the filling out of the molded material.

Each conventional stretch forming apparatus includes benders on both sides, which can bend a molding material only either forward or rearward. In order to bend a material both forward and rearward on the right and left sides for use as a part of the frame of a vehicle such as a truck, it is necessary for the conventional apparatus to mold the material twice by putting it again in the mold. Therefore, the molding efficiency of the apparatus is low, and it has been desired to improve the productivity.

SUMMARY OF THE INVENTION

It is an object of the present invention for solving the foregoing problems to provide a method of stretch-forming a channel material by feeding a channel material of predetermined length into a stretch forming apparatus and bending the material in predetermined form. The method includes placing a mold in the apparatus in symmetry forward and rearward of the apparatus so as to bend a channel material in lateral symmetry, arranging a plurality of cores along the mold in such a manner that they can be inserted into and removed from the inside of the material to be fed into the apparatus, supporting the arranged cores in such a manner that they can slide forward and rearward along the bend part of the material, and bending the material in predetermined forward and rearward directions while stretching both end portions of the material by means of stretch cylinders so as to form a forward and rearward symmetric molding at high production efficiency.

It is another object of the invention to stretch-form a material easily in desired form. This object can be achieved by arranging a wide core opposite to the straight part of the mold, and narrow cores opposite to the bend part of the mold in such a manner that they shift forward and rearward in order along the bend part.

It is another object of the invention to stretch-form a material with good balance. This object can be achieved by arranging the right and left stretch cylinders and benders in symmetry with respect to the mold, operating the benders on both sides at the same angular speed at the same time. Otherwise, the object can be achieved by arranging counterbalancing cylinders in symmetry on the right and left of the mold, and making adjustments by operating the counterbalancing cylinders dependently on the bending forces of the respective benders, so as to prevent the mold from being damaged.

It is a further object of the invention to stretch-form a channel material for a vehicle frame by easily bending the material forward and rearward. This object can be achieved by feeding the material into the mold of the stretch forming apparatus, and bending one side of the material forward and the other side rearward.

It is a further object of the invention to stretch-form a channel material which is C-shaped in cross section, beautifully without damaging the material. This object can be achieved by providing the cores in such a manner that they can be turned, and turning the cores to insert them into and remove them from the material.

The above and other objects and advantages of the present invention will be apparent from the following detailed description of preferred embodiments of the invention with reference to the accompanying drawings.

DETAILED DESCRIPTION OF THE INVENTION

Figure 1:
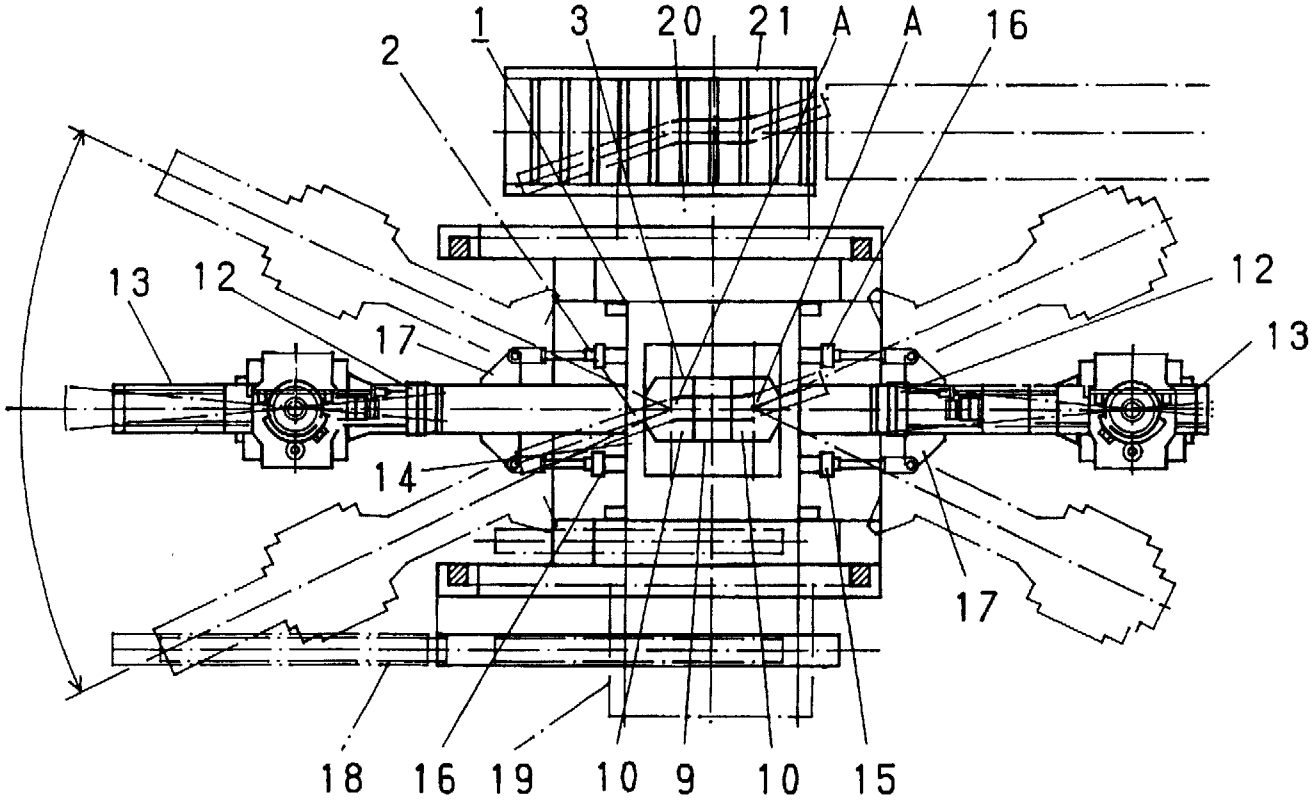
FIG. 1 is a plan view in cross section of a stretch forming apparatus according to one of the embodiments.

The invention will be described below on the basis of the embodiments.

A method of stretch forming a channel material of this invention is characterized by feeding a channel material of predetermined length into a stretch forming apparatus and bending the material in predetermined form, the method comprising of placing a mold in the apparatus in symmetry forward and rearward of the apparatus so as to bend a channel material in lateral symmetry, arranging a plurality of cores along the mold in such a manner that they can be inserted into and removed from the inside of the material to be fed into the apparatus, supporting the arranged cores in such a manner that they can slide forward and rearward along the bend part of the material and bending the material in predetermined forward and rearward directions while stretching both end portions of the material by means of stretch cylinders so as to form a forward and rearward symmetric molding.

The stretch forming apparatus according to the present invention includes a mold placed in forward and rearward symmetry in the central part of the apparatus, and stretch cylinders mounted through stretching jaws on the right and left of the mold. The cylinders can hold or grip both end portions of a molding channel material to be fed into the mold, and stretch the material with predetermined tensile force toward both sides.

The apparatus also includes benders with predetermined hydraulic force for bending a molding material both forward and rearward at the same time. The apparatus can therefore mold efficiently in predetermined form a pair of molding channel materials in forward and rearward symmetry for the frame of a vehicle such as a truck.

Cores are arranged side by side over or above the mold. For example, when a U-shaped material is molded, the cores for engagement with the space in the material can be inserted into and removed from the space. By moving the cores forward and rearward along the mold, it is possible to mold the material beautifully without deforming the sectional shape of the material.

Corresponding to the mold shape, the cores include a wide one for the straight part of the mold and narrow ones for the bend part of the mold. The cores can be moved forward and rearward in order along the mold so as to bend a molding material smoothly along the mold.

If the channel material has a narrow inlet opening as is the case with a C-shaped material, it is possible to mold the material by turning the cores to insert them into the C-shaped material through the opening, rotating them along the inner surface of the C-shaped material, and removing them from the C-shaped material in reverse order.

In the foregoing stretch forming, it is preferable for easy bending control that the material be bent at the same angular speed by the benders. Also, it is preferable for easy control that the material be bent around a position in symmetry with respect to the mold.

In particular, the apparatus further includes bender cylinders and counterbalancing cylinders with predetermined force in front, in the rear, on the right, and on the left of the die assembly. Therefore, even when bending one side of a molding material forward and the other side rearward, as is the case with a material for a vehicle frame, it is possible to mold the material in predetermined form, without damaging the die assembly etc. with excessive force, by operating the predetermined counterbalancing cylinder dependently on the bending forces of the benders so as to adjust the balance.

Figure 2:
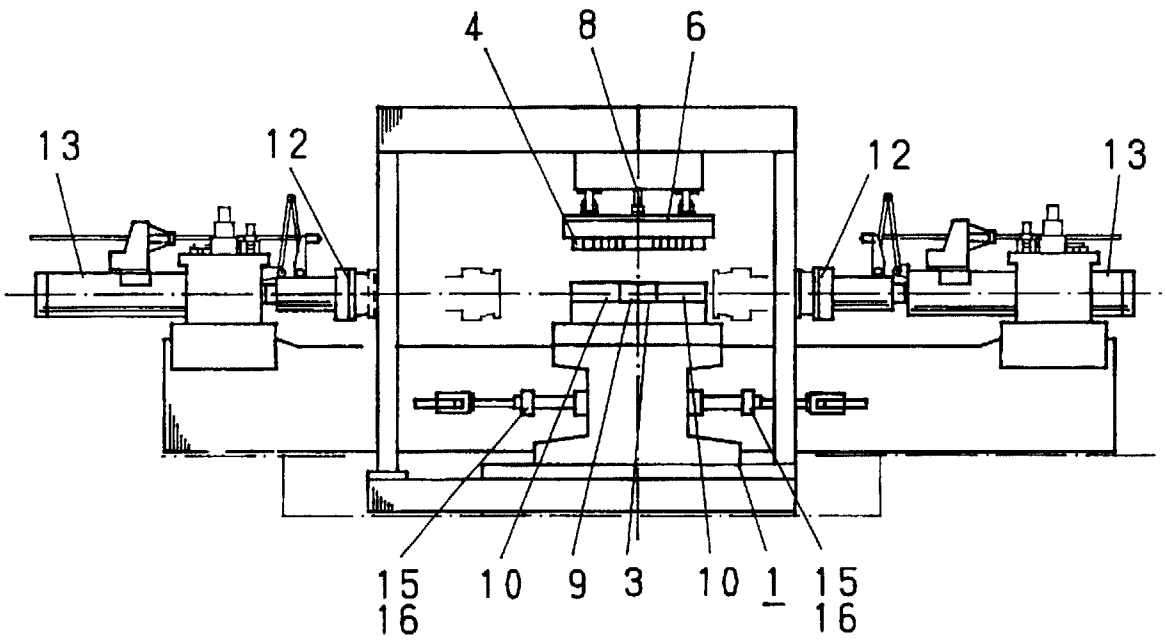
FIG. 2 is a side view of the apparatus shown in FIG. 1.

FIGS. 1–5 show the first embodiment of the present invention. The stretch forming apparatus I can mold a channel material 2 for the frame of a vehicle such as a truck. As shown in FIGS. 1 and 2, the apparatus 1 includes a mold 3 placed in symmetry forward and rearward of the apparatus in its central part. The mold 3 is shaped so as to correspond to the bent shape of the channel material 2.

As shown in FIGS. 2–5, cores 4 are arranged side by side and supported on slide shafts 5. A core support frame 6 can be moved vertically by a drive 8 so as to insert the cores 4 into and remove them from the inside of the channel material 2.

Figure 3:
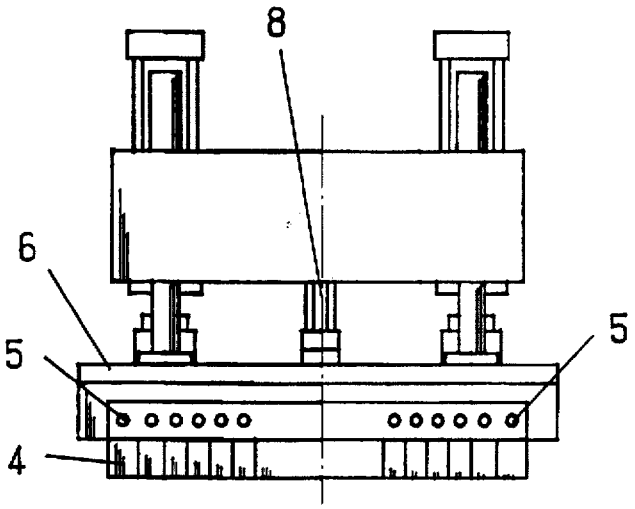
FIG. 3 is an enlarged front view of the cores etc. of the apparatus shown in FIG. 1.
Figure 4:
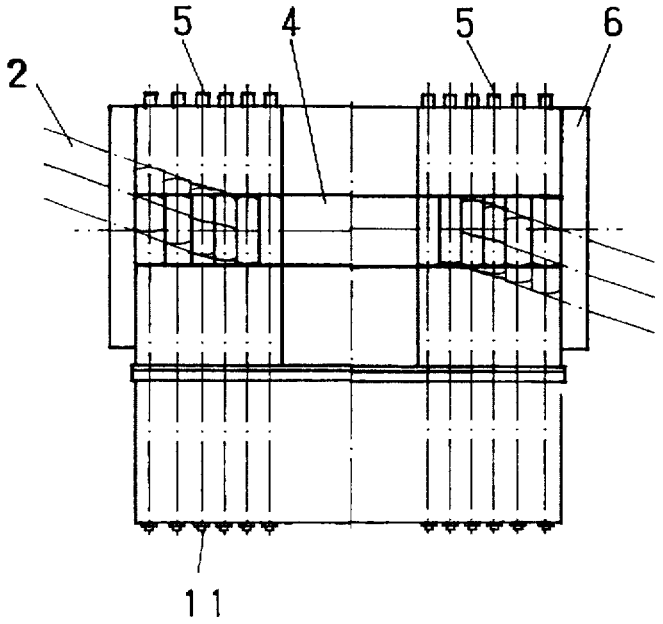
FIG. 4 is a plan view of the parts shown in FIG. 3.
Figure 5:
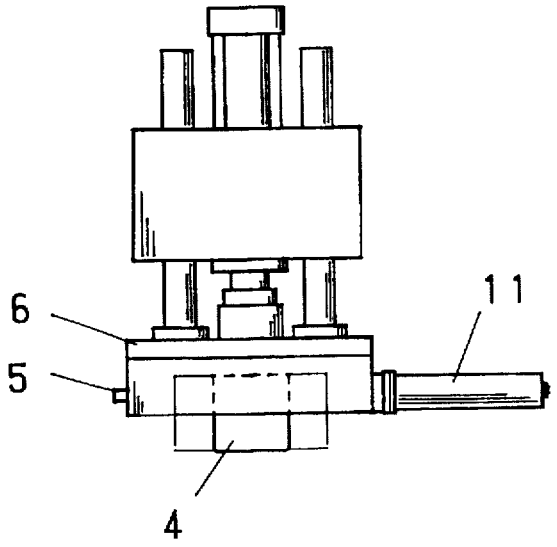
FIG. 5 is a side view of the parts shown in FIGS. 3 and 4.

As shown in FIG. 3, the cores 4 include a wide one for the straight center portion 9 of the mold 3 and narrow ones for both bending sides 10 thereof. As shown in FIG. 4, the cores 4 can move forward and rearward along the mold 3. A spring device 11 is fitted with a coil spring in it so as to return each movable core 4 centrally for the next molding after a channel material is molded.

As shown in FIGS. 1 and 2, bender frames 14 are fitted with stretching jaws 12 and stretch cylinders 13 on the right and left of the mold 3. It is possible to mold a channel material 2 by bending the material forward and rearward with bender cylinders 15. The bender cylinders 15 and counterbalancing cylinders 16 are arranged in symmetry forward and rearward of the mold 3. The cylinders 16 counterbalance the bending forces of the cylinders 15 for forward and rearward forming.

The right and left bender cylinders 15 can bend a channel material through linkages 17. The cylinders 15 hydraulically control bending center parts in symmetry laterally of the mold 3 at the same predetermined angular speed, so as to easily bend a channel material 2. If necessary, it is possible to bend a material at different angular speeds required on the right and left sides. The apparatus 1 also includes a loading conveyor 18, a loading carriage 19, a unloading carriage 20 and a unloading conveyor 21 to automatically carry, mold and take out a channel material 2.

A displacement may occur between the tangential direction of each bend line of a molding and the rotational center A of the associated bender frame 14. In this case, the stretching forces of the stretch cylinders 13 bend a molding material independently of the torque of the bender cylinders 15. The counterbalancing cylinders 16 act to cancel the torque developed by the stretching forces. The cylinders 15 and 16 are arranged in forward and rearward symmetry. When a material is molded on one side, the cylinders on the other side are used as counter balances.

Therefore, as shown in FIGS. 1 and 4, even a molding material 2 for a vehicle frame or the like can be bent forward on one side and rearward on the other after taken in once. As a result, the molding efficiency can be improved.

Figure 6:
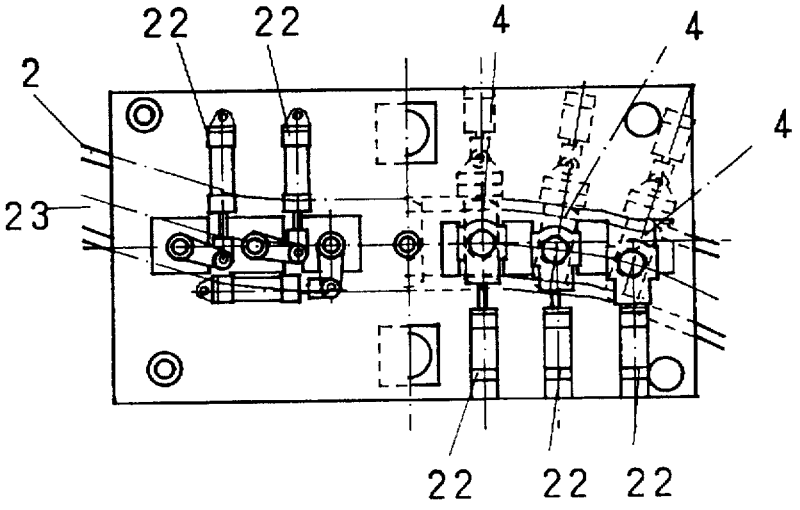
FIG. 6 is a plan view of a stretch forming apparatus according to another embodiment.
Figure 7:
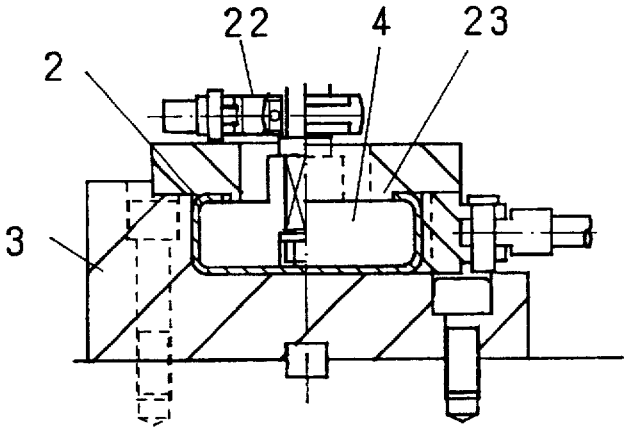
FIG. 7 is a vertical cross section of the apparatus shown in FIG. 6.

FIGS. 6 and 7 show the second embodiment, which can bend a channel material 2 C-shaped in cross section. As shown in FIGS. 6 and 7, cores 4 can be turned by drives 22 horizontally by predetermined angles. The cores 4 can be inserted into and removed from the narrow opening 23 of the material to mold the material as stated above.

It is thus possible to stretch-form beautifully through the cores, as stated above, even a molding material C-shaped in cross section and having a narrow opening.

The embodiments have been described in conjunction with a channel material for a vehicle frame and a channel material C-shaped in cross section. It is possible to mold even H-shaped steel by inserting and removing the cores up and down. In accordance with the object of the present invention, it is likewise possible to apply the invention to channel materials similar to the foregoing.

Thus, in accordance with the present invention, it is possible to stretch-form at high production efficiency even a laterally symmetric channel material for a vehicle frame or the like.

The counterbalancing cylinders are arranged on the right, on the left and in front and in the rear of the mold, and can be operated to counterbalance the bending forces of the bender cylinders. It is therefore possible to stretch-form a material with good balance without excessively loading and damaging the die assembly.

For a channel material C-shaped in cross section, the cores can be turned to be inserted into and removed from the material. It is therefore possible to stretch-form a C-shaped channel material beautifully without deforming the material.

What is claimed is:

1. A method of stretch-forming a channel material by feeding a channel material of predetermined length into a stretch forming apparatus and bending the material in predetermined form, the method comprising the steps of:

placing a mold in the apparatus in symmetry forward and rearward with respect to a length dimension of the apparatus so as to form a laterally symmetric bend in the channel material;

arranging a plurality of cores along the mold in such a manner that they can be inserted into and removed from the inside of a channel material to be fed into the apparatus, and supporting the arranged cores in such a manner that they can slide rightward and leftward with respect to the length dimension of the apparatus along the bend part of the material;

providing a spring device fitted in the mold area to centrally bias, for the next forming, the mold cores shifted rightward and leftward; and bending the material in predetermined rightward and leftward directions so as to form said laterally symmetric bend, while stretching both end portions of the material by means of stretch cylinders.

2. The method of stretch-forming a channel material according to claim 1, further including the step of:

providing a wide core positioned opposite to a straight part of the mold, and narrow cores positioned opposite to a bend part of the mold in such a manner that the cores shift rightward and leftward along the bend part.

3. The method of stretch-forming a channel material according to claim 1, further including the steps of:

arranging right and left stretch cylinders and benders symmetrically with respect to the mold; and operating the benders on both sides at a same angular speed at the same time.

4. The method of stretch-forming a channel material according to claim 3, further including the step of positioning forming bend center parts of the right and left bender cylinders in lateral symmetry.

5. The method of stretch-forming a channel material according to claim 3, further including the steps of:

arranging counterbalancing cylinders in symmetry on the right and left of the mold; and making adjustments by operating the counterbalancing cylinders dependently on the bending forces of the respective benders.

6. The method of stretch-forming a channel material according to claim 5, further including the steps of:

arranging the bender cylinders and the counterbalancing cylinders symmetrically in front and in the rear of the mold, the cylinders being controllable for use as counter balances and benders; and using the cylinders in such a manner that, when either the bender cylinders or the counterbalancing cylinders act as the bender cylinders, the other cylinders act as the counterbalancing cylinders.

7. The method of stretch-forming a channel material according to claim 1, further including the steps of:

feeding a channel material for a vehicle frame into the mold of the stretch forming apparatus; and bending one side of the material forward and the other side rearward.

8. The method of stretch-forming a channel material according to claim 1, further including the step of:

providing the material being C-shaped in cross section with a narrow opening, the cores having a width wider than the opening and being able to be turned; and turning the cores by 90 degrees to insert them into and remove them from the material through opening.

9. The method of stretch-forming a channel material according to claim 2, further including the step of:

providing the material being C-shaped in cross section with a narrow opening, the cores having a width wider than the opening and being turnable; and turning the cores by 90 degrees to insert them into and remove them from the material through the opening.

10. The method of stretch-forming a channel material according to claim 3, further including the step of:

providing the material being C-shaped in cross section with a narrow opening, the cores having a width wider than the opening and being turnable; and turning the cores by 90 degrees to insert them into and remove them from the material through the opening.

11. The method of stretch-forming a channel material according to claim 4, further including the step of:

providing the material being C-shaped in cross section with a narrow opening, the cores having a width wider than the opening and being turnable; and turning the cores by 90 degrees to insert them into and remove them from the material through the opening.

12. The method of stretch-forming a channel material according to claim 5, further including the step of:

providing the material being C-shaped in cross section with a narrow opening, the cores having a width wider than the opening and being turnable; and turning the cores by 90 degrees to insert them into and remove them from the material through the opening.

13. The method of stretch-forming a channel material according to claim 6, further including the step of:

providing the material being C-shaped in cross section with a narrow opening, the cores having a width wider than the opening and being turnable; and turning the cores by 90 degrees to insert them into and remove them from the material through the opening.

14. The method of stretch-forming a channel material according to claim 7, further including the step of:

providing the material being C-shaped in cross section with a narrow opening, the cores having a width wider than the opening and being turnable; and turning the cores by 90 degrees to insert them into and remove them from the material through the opening.

* * * * *